US005960573A

United States Patent [19]

Wong

[11] Patent Number: 5,960,573

[45] Date of Patent: Oct. 5, 1999

[54] WALL HANGING PICTURE FRAME

[76] Inventor: Man-Chiang Wong, 4401 Jacaranda, Burbank, Calif. 91505

[21] Appl. No.: 08/971,650

[22] Filed: Nov. 17, 1997

[51] Int. Cl.[6] ..... G09F 1/12

[52] U.S. Cl. ..... 40/757; 40/737; 40/765; 40/771; 40/799

[58] Field of Search ..... 40/732, 737, 757, 40/765, 768, 771, 776, 799, 159, 654.01, 537

[56] References Cited

U.S. PATENT DOCUMENTS

| | | | |
|---|---|---|---|
| 3,707,053 | 12/1972 | Itano | 40/757 X |
| 3,842,525 | 10/1974 | Deau | 40/765 X |
| 3,983,650 | 10/1976 | Payson | 40/737 |
| 4,145,829 | 3/1979 | Peltier | 40/771 |
| 4,310,976 | 1/1982 | Wilten | 40/737 |
| 4,967,498 | 11/1990 | Kao | 40/799 |
| 4,996,784 | 3/1991 | Hsu | 40/799 |
| 5,148,618 | 9/1992 | Brewster | 40/771 X |
| 5,586,401 | 12/1996 | Sheehan et al. | 40/737 |
| 5,638,623 | 6/1997 | Sheun | 40/732 X |

FOREIGN PATENT DOCUMENTS

| | | | |
|---|---|---|---|
| 2242127 | 9/1991 | United Kingdom | 40/799 |

*Primary Examiner*—Terry Lee Melius
*Assistant Examiner*—Robert G. Santos
*Attorney, Agent, or Firm*—Raymond Y. Chan; David and Raymond

[57] ABSTRACT

A wall hanging picture frame includes a transparent board, a picture holding pocket body, and a quadrilateral holding frame. The holding frame is smaller than the transparent board and positioned on a front surface of the transparent board and has at least two connectors extended backwardly from two opposing sides thereof. The picture holding pocket body is positioned behind the transparent board and is concentrically aligned with the holding frame. The transparent board has at least two through holes provided thereon and aligned with respect to the two connectors of the holding frame to enable the holding frame being mounted on the transparent board by penetrating through the two through holes thereof. A securing means is secured with the two connectors of the holding frame for affixing the holding frame on the front surface of the transparent board and firmly holding the picture holding pocket body in position so as to define a receiving pocket between a back surface of the transparent board and the picture holding pocket body for receiving the picture therein. By means of securing means, the wall hanging picture frame is adapted to be hanged onto a wall.

11 Claims, 7 Drawing Sheets

WALL HANGING PICTURE FRAME

FIELD OF THE PRESENT INVENTION

The present invention relates to a picture frame, and more particularly to a wall hanging picture frame which enables the user to easily replace the picture placed therein and improves the view of the picture to have more three dimensional effect so that the picture would be more lively to provide more visual pleasure.

BACKGROUND OF THE PRESENT INVENTION

As shown in FIGS. 1 and 2, a conventional picture frame for displaying favorite picture comprises a frame 10A, a transparent layer 20A such as glass, plastic, or acrylic mounted therebehind and a background plate 30A mounted behind the transparent layer 20A. The background plate 30A has a size equal to or larger than the transparent layer 20A so as to define a receiving room therebetween for keeping a picture or art work P. Generally, the frame 10A is a quadrilateral frame comprising a first, a second, a third and a fourth elongated side strip side strips 11A, 12A, 13A, 14A that each of which has a L-shaped cross section to define a cavity 15A bounded by the four side strips 11A, 12A, 13A, 14A. The frame 10A further provides a plurality of background plate holders 16A, 17A, 18A, 19A integrally extended from the four side strips 11A, 12A, 13A, 14A of the frame 10A respectively.

The assembly procedure of the conventional picture frame 11A is so troublesome that includes the following steps of:

1) mounting the transparent layer 20A on the cavity 15A bounded by the four side strips 11A, 12A, 13A, 14A of the frame 10A;
2) placing a picture or art work P on the transparent layer 20A;
3) placing the background plate 30A behind the picture or art work P; and
4) locking the background plate 30A, the picture or artwork P and the transparent layer 20A in position by the background plate holders 16A, 17A, 18A, 19A.

The above described convention picture frame 10A has been used for years to preserve and display the picture or art work of what you are proud of, but it still contains many drawbacks that should be improved to make it become more user friendly.

One of the drawbacks is that the conventional picture frame is not easy for the user to either insert or remove the picture therein, the user needs to perform all four steps mentioned above, and that the background plate 30A is very tough to be correctly positioned and bounded by the background plate holders 16A, 17A, 18A, 19A.

The conventional picture frame is not design for frequent change of the displaying picture or art work, so it does not consider making that task simple. But most people would like to change different pictures or art works from time to time or after a while of seeing the same old things. As mentioned above in procedure 3), even if the user can correctly position and bound the background plate 30A by the background plate holders 16A, 17A, 18A, 19A on top of the picture or art work P, when the user wants to replace the picture, or art work, most users may find difficulty of taking out the background plate 30A since it is firmly bounded by the background plate holders 16A, 17A, 18A, 19A. When the user tries to do such task with too much force, the background plate holders 16A, 17A, 18A, 19A have a tendency to break off from the four side strips 11A, 12A, 13A, 14A and the whole frame becomes unusable.

Another shortcoming of the conventional picture frame is that the picture P is bounded by the four side strips 11A, 12A, 13A, 14A so as to hold the picture P in position within the frame 10A, in other words, the four side strips 11A, 12A, 13A, 14A of the picture frame 10A forms a border of the picture P that often makes the people focusing on the surrounding frame rather than the picture itself. Also, since all conventional picture frames come with preset color and ornamental design, the user might need to spend long time on selecting the right style of picture frame picture to match with the content of the picture due to the fact that if it is not properly match, the frame would ruin the artistic aspect of the picture. For most circumstances, the picture itself is the dominant feature to displace but not the frame.

SUMMARY OF THE PRESENT INVENTION

The main objective of the present invention is to provide a wall hanging picture frame which can allow a picture or art work to be easily held in position, and whenever the user desires to replace the picture or art work, the replacing step is as simple as removing the old picture and inserting the new picture.

Another objective of the present invention is to provide a wall hanging picture frame, which can improve the aesthetic view of a picture or art work.

Still another objective of the present invention is to provide a wall hanging picture frame, in which the frame color can be easily changed to match with different moods of the picture or art work without replacing the entire picture frame.

Accordingly, a wall hanging picture frame comprises a transparent board having a size larger than a size of a picture (or art work) to be framed, a picture holding pocket body having a size slightly larger than the size of the picture and smaller than the size of the transparent board, and a quadrilateral holding frame having an outer size larger than the picture holding pocket body and an inner size smaller than a periphery size of the picture. The holding frame is positioned on a front surface of the transparent board and has at least two connectors extended backwardly from two opposing sides thereof. The picture holding pocket body is positioned behind the transparent board and is concentrically aligned with the holding frame. The transparent board has at least two through holes provided thereon and aligned with respect to the two connectors of the holding frame to enable the holding frame being mounted on the transparent board by penetrating through the two through holes thereof. A securing means is secured with the two connectors of the holding frame for affixing the holding frame on the front surface of the transparent board and firmly holding the picture holding pocket body in position so as to define a receiving pocket between a back surface of the transparent board and the picture holding pocket body for receiving the picture therein. By means of securing means, the wall hanging picture frame is adapted to be hanged onto a wall.

The picture holding pocket body having a first edge, a second edge, a third edge, and a fourth edge, in which between the first edge and a back surface of the transparent board forms an opening for allowing the picture or art work to be inserted therethrough. The second edge, the third edge and the fourth edge of the picture holding pocket body are all sealed to the back surface of the transparent board by adhesive material to form the receiving pocket therebetween. Thereby, when the user inserts a picture through the opening, the picture would stay in the pocket. The wall hanging picture frame with a design of the opening allows the picture to be easily inserted into the wall hanging picture frame for as many times as the user desires. The user may replace the picture from time to time by simply taking out an old picture and inserting a new picture.

The securing means comprises at least two securing heads adapted for securing to the two connectors of the holding frame respectively. Each securing head has a connecting hole to affixed one end of a hanging string. By affixing two ends of the hanging string to the two securing heads, the wall hanging picture frame of the present invention can thus be hanged on a wall surface.

DETAILED DESCRIPTION OF THE PREFERRED EMBODIMENT

Figure 1:
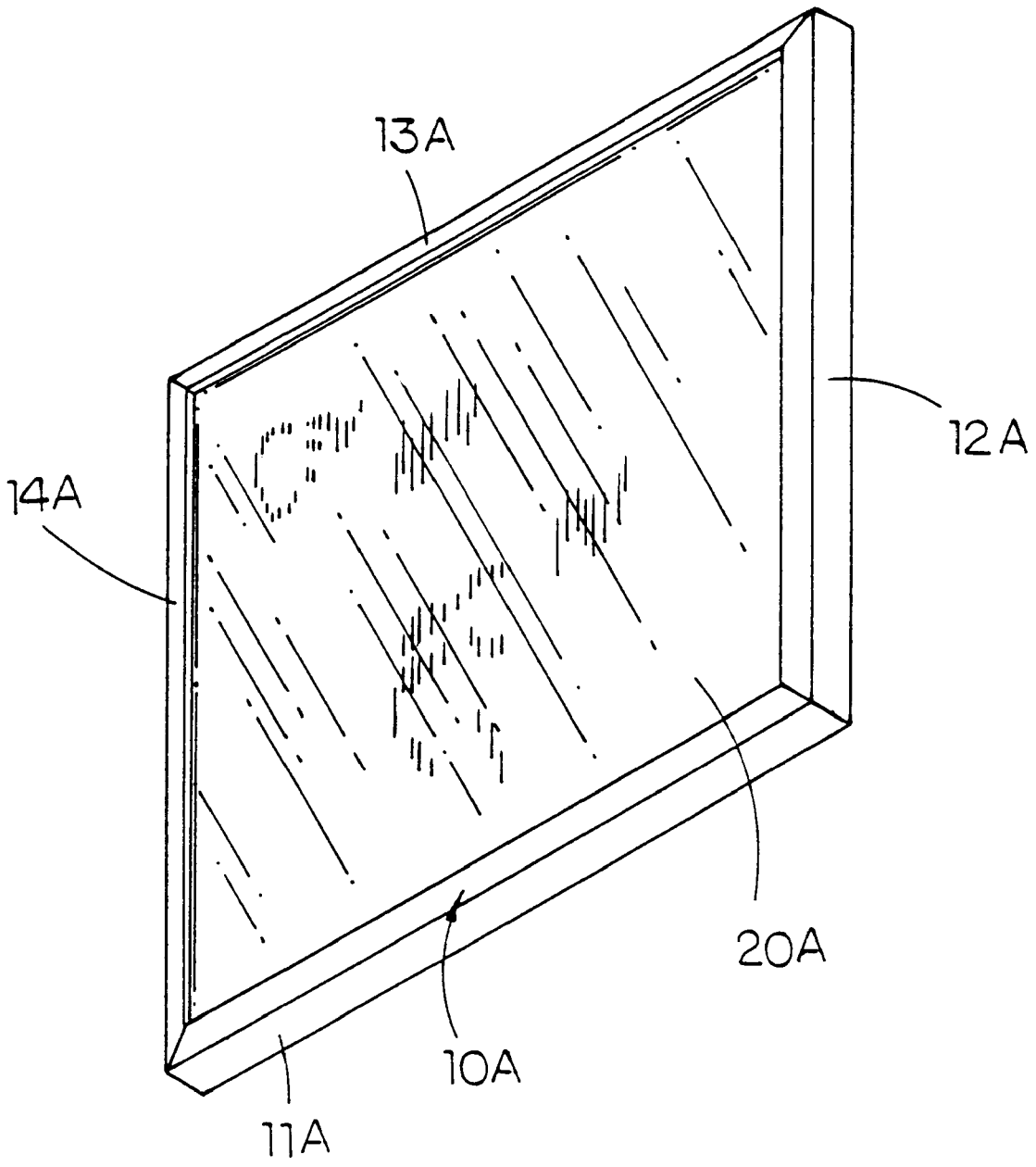
FIG. 1 PRIOR ART
FIG. 1 is a perspective view of a conventional picture frame.
Figure 2:
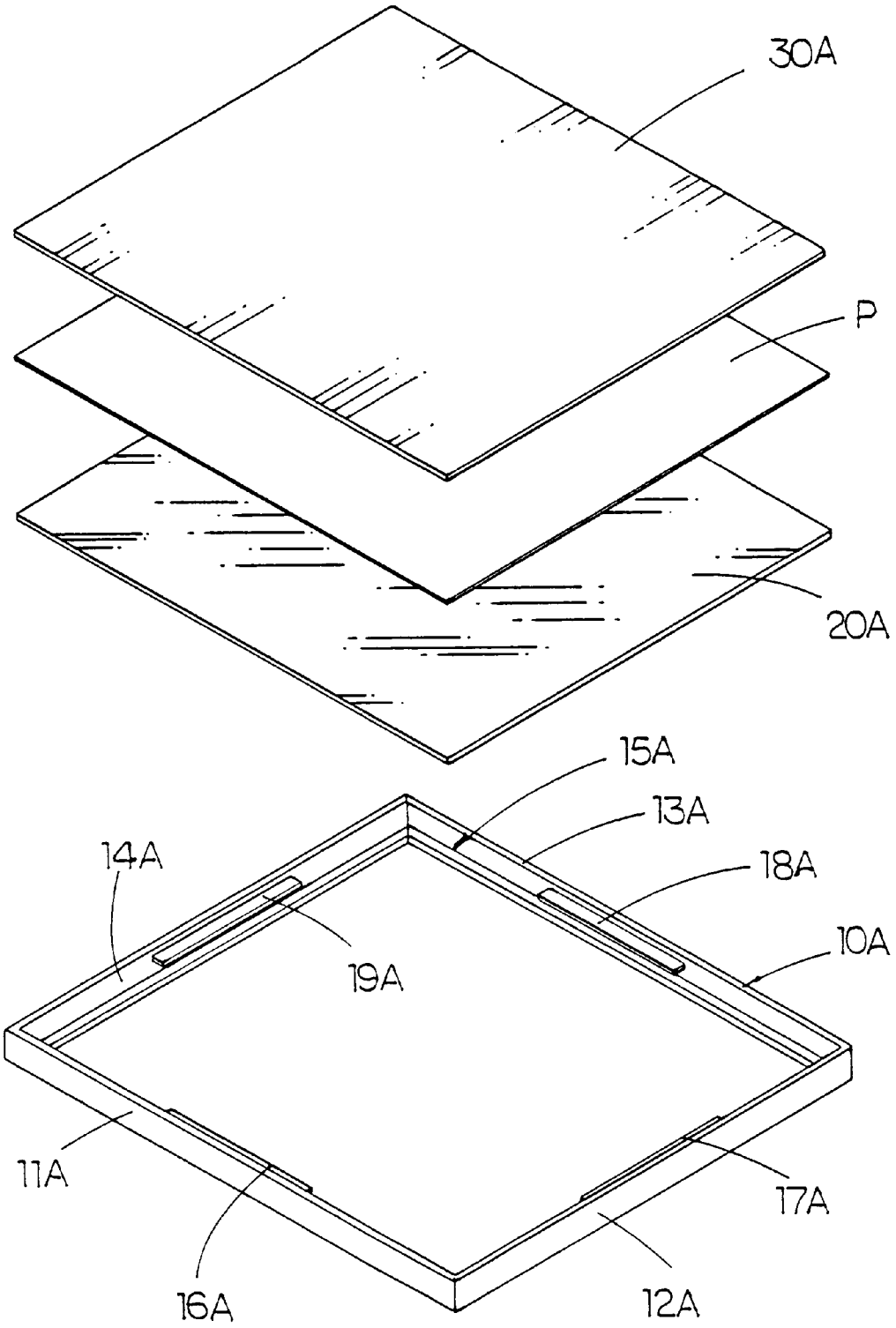
FIG. 2 PRIOR ART
FIG. 2 is an exploded perspective view of the above conventional picture frame.
Figure 3:
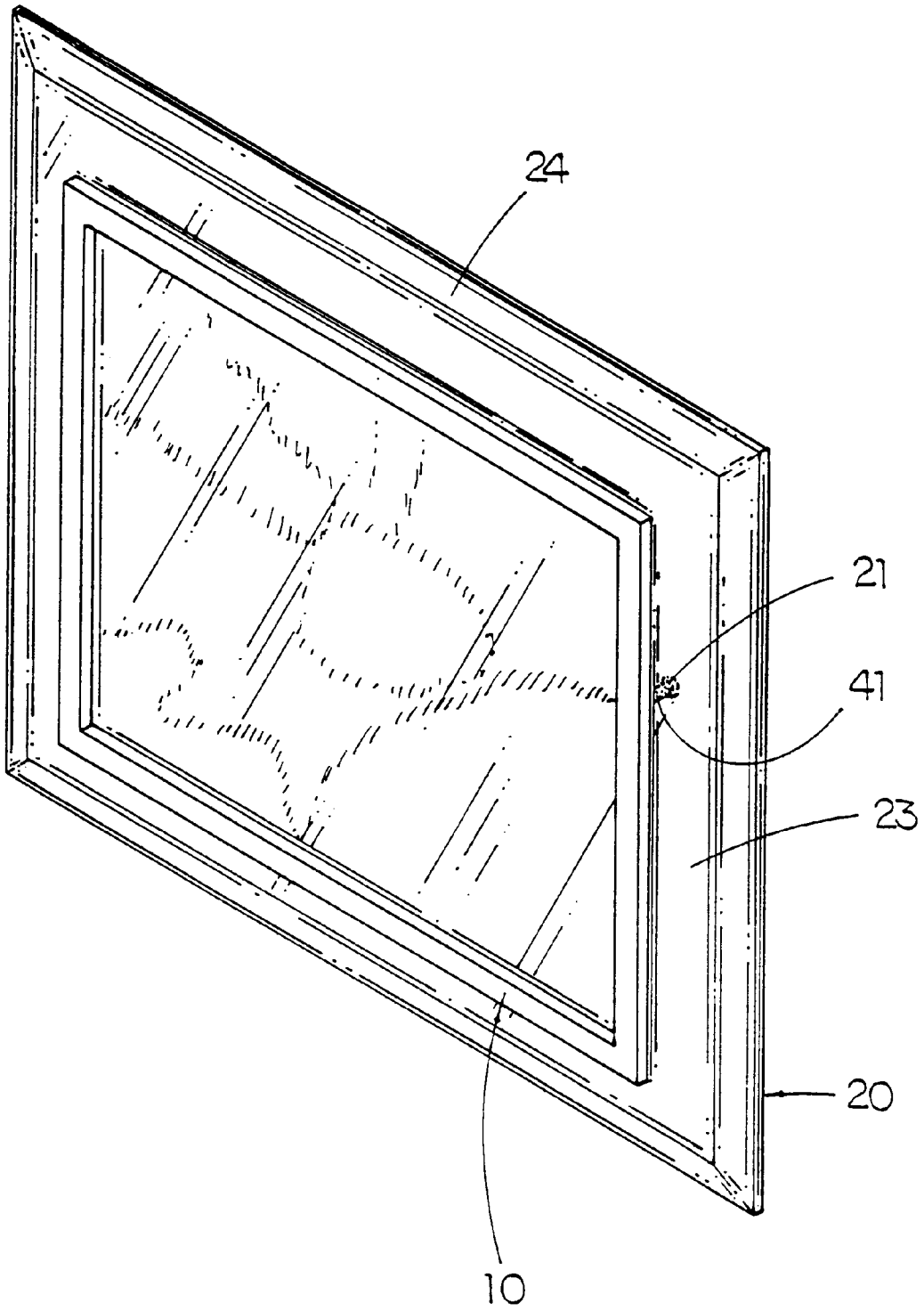
FIG. 3 is a perspective view of a wall hanging picture frame according to a first preferred embodiment of the present invention.
Figure 4:
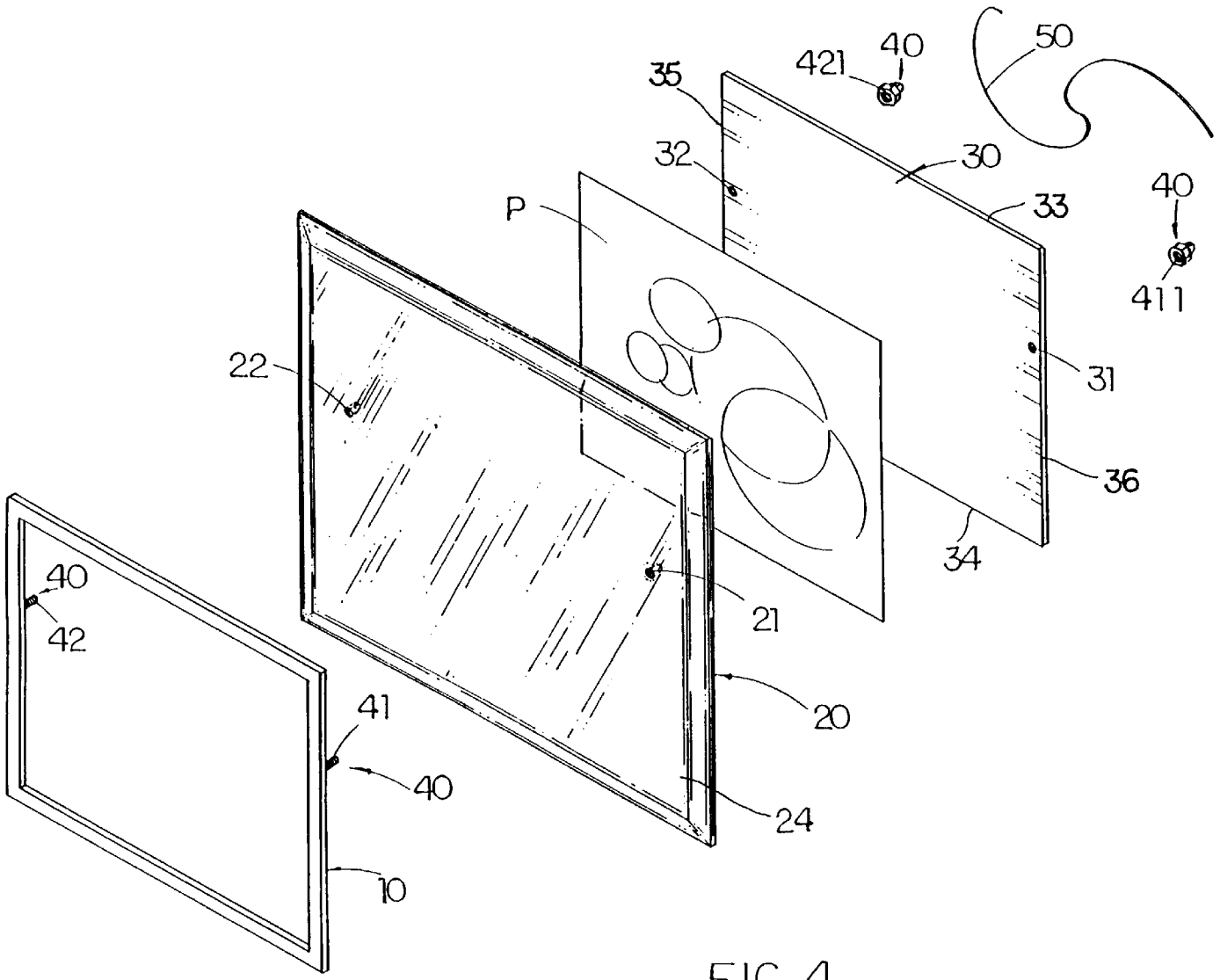
FIG. 4 is an exploded perspective view of the wall hanging picture frame according to the above first preferred embodiment of the present invention.
Figure 5:
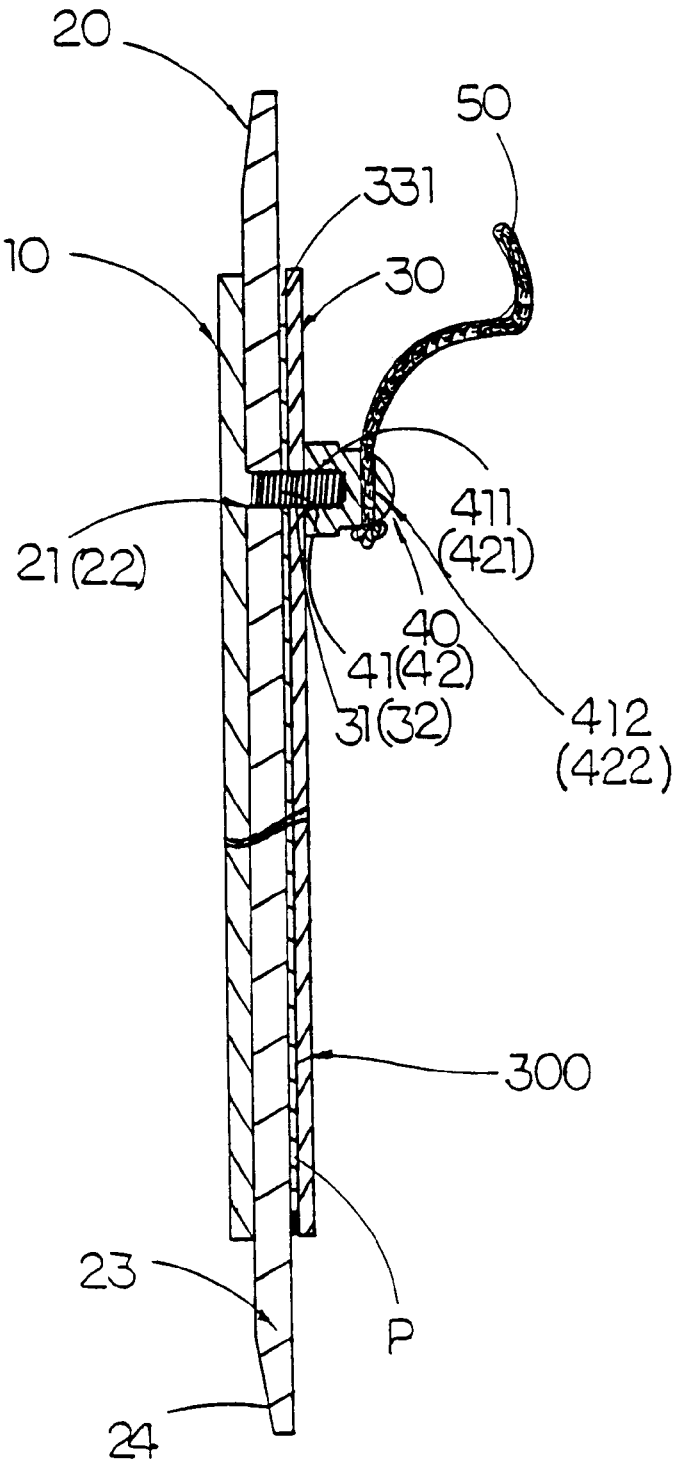
FIG. 5 is a sectional end view of the wall hanging picture frame according to the above first preferred embodiment of the present invention.

Referring to FIGS. 3 to 5 of the drawings, a wall hanging picture frame according to a first preferred embodiment of the present is illustrated. The wall hanging picture frame comprises a quadrilateral holding frame 10, a transparent board 20, a picture holding pocket body 30, and a connecting means 40.

The transparent board 20 has a size larger than a size of a picture or an artwork P to be framed. The picture holding pocket body 30 has a size slightly larger than the size of the picture P and smaller than the size of the transparent board 20. The holding frame 10 has an outer periphery size larger than that of the picture holding pocket body 30 and an inner periphery size smaller than a periphery size of the picture P. The holding frame 10 is positioned on a front surface of the transparent board 20. The picture holding pocket body 30 is positioned behind the transparent board 20 and is concentrically aligned with the holding frame 10.

The connecting means 40 comprises at least two connectors 41, 42 integrally extended backwardly from two opposing sides of the holding frame 10. The transparent board 20 has at least two through holes 21, 22 provided thereon and aligned with respect to the two connectors 41, 42 protruded from the holding frame 10 to enable the holding frame 10 being mounted on the transparent board 20 by penetrating through the two through holes 21, 22 thereof. The connecting means further comprises a securing means to secure with the two connectors 41, 42 of the holding frame 10 for affixing the holding frame 10 on the front surface of the transparent board 20 and firmly holding the picture holding pocket body 30 in position, so as to define a receiving pocket 300 between a back surface of the transparent board 20 and the picture holding pocket body 30 for receiving the picture P therein. By means of securing means, the wall hanging picture frame of the present invention can be adapted for hanging onto a wall.

The securing means comprises at least two securing heads 411, 421 adapted for securing to the two connectors 41, 42 of the holding frame 10 respectively. Each securing head 411, 421 has a connecting hole 412, 422 to affix one end of a hanging string 50. By affixing two ends of the hanging string 50 to the two securing heads 411, 421, the wall hanging picture frame of the present invention can thus be hanged on a wall surface. Of course, any other supporting device can be installed between the two securing heads 411, 421 for hanging or supporting the wall hanging picture frame of the present invention.

As shown in FIG. 4 of the drawings, the holding frame 10 can be made of plastic, wood or metal to have a slim width aimed to hold the picture holding pocket body 30 in position. The picture holding pocket body 30 can be a plastic board or even a card board which has a first edge 33, a second edge 34, a third edge 35, and a fourth edge 36, in which between the first edge 33 and the back surface of the transparent board 20 forms an opening 331 for allowing the picture or art work to be inserted therethrough into the receiving pocket 300. The second edge 34, the third edge 35 and the fourth edge 36 of the picture holding pocket body 30 are all sealed to the back surface of the transparent board 20 by adhesive material to form the receiving pocket 300 therebetween. Thereby, when the user inserts the picture P through the opening 331, the picture P would stay in the receiving pocket 300. The wall hanging picture frame with a design of the opening 331 allows the picture P to be easily inserted into the wall hanging picture frame for as many times as the user desires. The user may replace the picture P from time to time by simply taking out the old picture and inserting a new picture.

Referring to FIG. 4, according to the first preferred embodiment, the two connectors 41, 42 are two bolts integrally and backwardly extended from a left and a right side of the quadrilateral holding frame 10. The two securing heads 411, 421 are two matching round cap nuts adapted for screwing to the ends of the two bolts 41, 42 in order to compress the holding frame 10 and the picture holding pocket body 30 onto the front and back surfaces of the transparent board 20 respectively so as to hold the picture P received in the receiving pocket 300 rigidly in position.

In order to more firmly hold the picture holding pocket body 30 in position, the picture holding pocket body 30 further has at least two holding holes 31, 32 provided thereon, wherein the two holding holes 31, 32 must be aligned with respect to the two through holes 21, 22 on the transparent board 20, so that the two connectors 41, 42 (i.e. the two bolts) will also penetrate through the two holding holes 31, 32 to mount the picture holding pocket body 30 in position. If the compression pressure between the picture holding pocket body 30 and the transparent board 20 is firm enough, the edges 34, 35, 36 of the picture holding pocket body 30 may even do not need to glue onto the back surface of the transparent board 20.

According to FIGS. 2 to 5 of the drawings, the outer periphery size of the quadrilateral holding frame 10 according to the present invention is smaller than the size of the transparent board 20, so that a periphery transparent border frame 24, as shown in FIG. 3, is formed surrounding the slim holding frame 10, which is actually an outer portion of the transparent board 20. The existence and presence of such transparent border frame 24 enables the present invention matching with any kind of picture. The quadrilateral holding frame 10 does not become the center of attention and boundary limitation anymore. Instead, the picture positioned therein would be remained as the dominant of the display. The viewer of the picture who would view the picture from a distance would therefore observe a more three dimensional view effect and thus enhance the aesthetic view pleasure. Also the user may simply exchange the cheaper holding frame 10 of different shape, material, or color to meet the required by the user for different types of displaying effect without changing the entire more expensive picture frame.

It is worth to mention that because the transparent board 20 is further extended outside of the quadrilateral holding frame 10, as shown in FIG. 5, an excess portion 23 of the transparent board 20 can provide a plurality of bend edges or even craved with different art shapes or words to show off the picture position therein.

Figure 6:
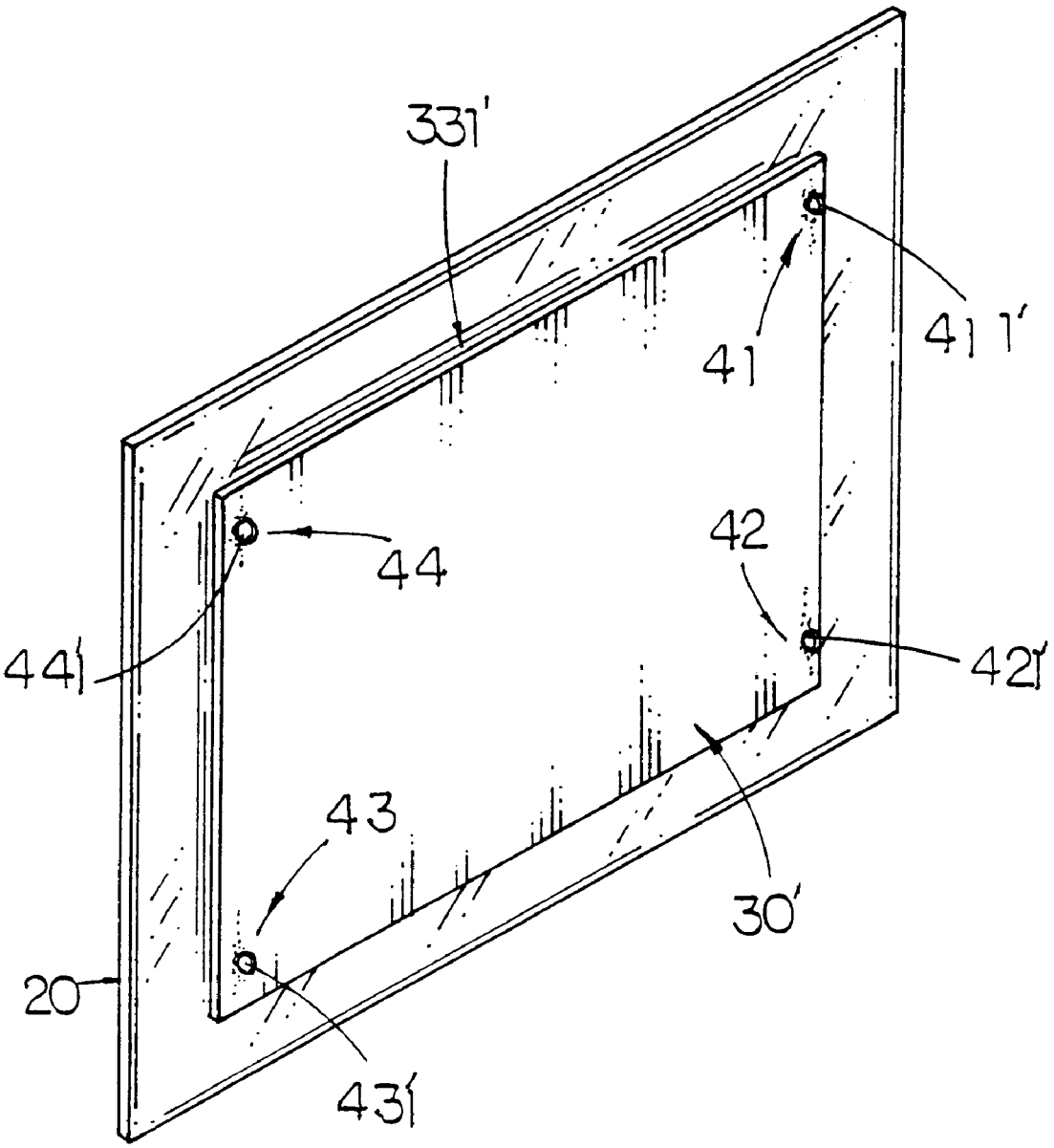
FIG. 6 is a rear perspective view of a wall hanging picture frame according to a second preferred embodiment of the present invention.
Figure 7:
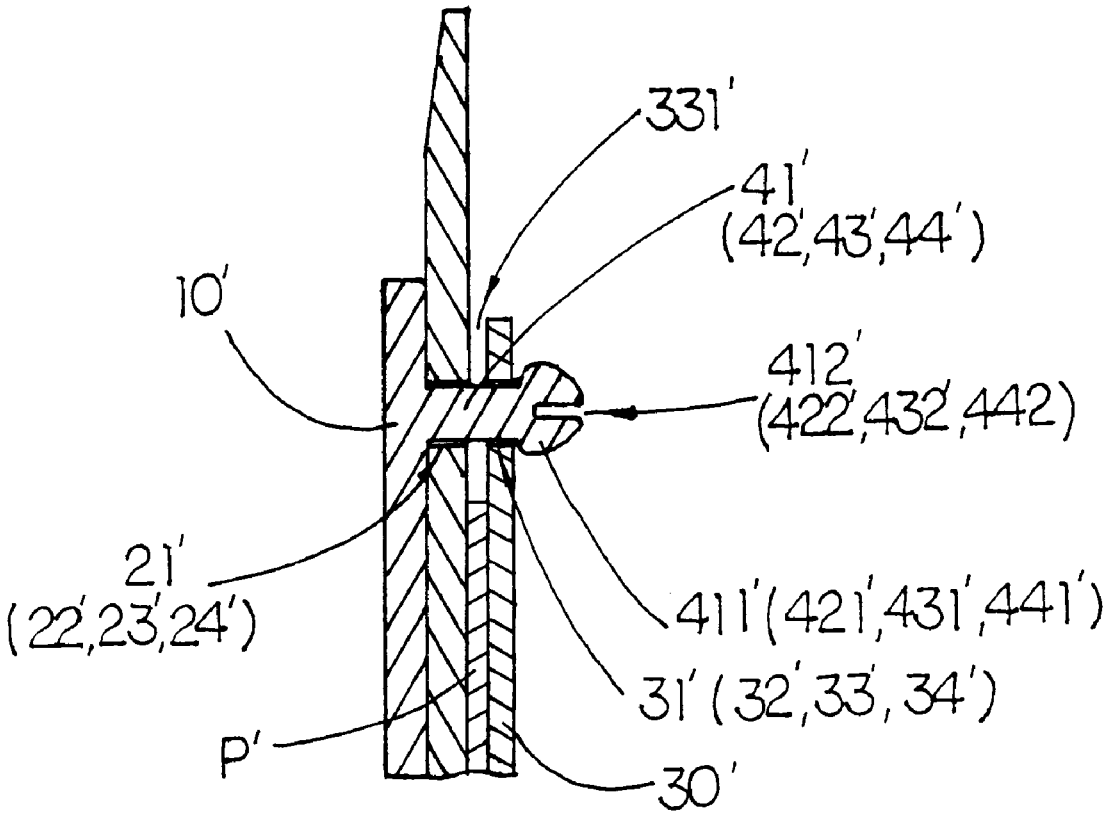
FIG. 7 is a partial sectional end view of the wall hanging picture frame according to the above second preferred embodiment of the present invention.

Referring to FIGS. 6 and 7 of the drawings, a wall hanging picture frame according to a second preferred embodiment of the present invention is illustrated, which is basically identical to the above first embodiment except that the connecting means 40' of the second preferred embodiment comprises four connector 41', 42', 43', 44' integrally extended out from four comers of the back side of the quadrilateral holding frame 10'. Each connector 41', 42', 43', 44' has an ending enlarged head 411', 421', 431', 441' acting as the securing heads of the first embodiment. Each enlarged head 411', 421', 431', 441' has a through slot 412', 422', 432', 442' to provide elastic feature.

The transparent board 20' of course has totally four through holes 21', 22', 23', 24' provided at four respective corners, and that the picture holding pocket body 30' also has four holding holes 31', 32', 33', 34' provided at four corresponding corners. The four enlarged heads 411', 421', 431', 441' can thus be compressed and forced to penetrate through the four through holes 21', 22', 23', 24' of the transparent board 20' and the four holding holes 31', 32', 33', 34' of the picture holding pocket body 30' respectively in order to secure the picture holding pocket body 30' as well as the picture P' inside firmly in position.

It is worth to mention that simple alternative modes having similar functions are easily be modified from the above embodiments disclosed in the present invention. Examples of such alternative modes include that two holding strips can be used to substitute the single quadrilateral holding frame 10, wherein each holding strip may have one or two connector(s) extended integrally and backwardly; that the connectors and the holding frame can be separated components, wherein holes may be formed on the holding frame to enable the connectors passing through; and that the holding frame can even be eliminated and the connectors are simply connected with the securing heads.

I claim:

1. A wall hanging picture frame, comprising a transparent board which has at least two opposing through holes provided thereon having a size larger than a size of a picture to be framed;

a picture holding pocket body which is placed behind said transparent board and has a size slightly larger than said size of said picture and smaller than said size of said transparent board, said picture holding pocket body having a first edge, a second edge, a third edge, and a fourth edge, wherein said second edge, said third edge and said fourth edge of said picture holding pocket body are all sealed to a back surface of said transparent board, so as to form a receiving pocket between said back surface of said transparent board and said picture holding pocket body for receiving said picture, and an opening between said first edge and said back surface of said transparent board for allowing said picture to be inserted therethrough into said receiving pocket;

a holding frame, which is positioned on a front surface of said transparent board, having an outer periphery size larger than that of said picture holding pocket body and an inner periphery size smaller than a periphery size of said picture, said holding frame being concentrically aligned with said picture holding pocket body, wherein a periphery transparent border frame is formed on said transparent board to surround said holding frame;

a connecting means comprising at least two connectors extended backwardly from said holding frame to penetrate through said two through holes on said transparent board for mounting said holding frame on said front surface of said transparent board, said connecting means further comprising a securing means to secure with two ends of said two connectors for affixing said holding frame firmly in position and firmly holding said picture holding pocket body in position; and supporting means connecting to said securing means for supporting said entire wall hanging picture frame.

2. A wall hanging picture frame, as recited in claim 1, wherein said securing means comprises at least two securing heads to secure to said two connectors of said holding frame respectively.

3. A wall hanging picture frame, as recited in claim 2, wherein each of said securing heads has a connecting hole, and that said supporting means comprises a hanging string having two ends affixed with said two connecting holes of said two securing heads respectively for hanging and supporting said wall hanging picture frame.

4. A wall hanging picture frame, as recited in claim 3, wherein said holding frame is a quadrilateral holding frame and said two connectors are two bolts integrally and backwardly extended from a left and a right side of said quadrilateral holding frame, and that said two securing heads are two matching round cap nuts screwed to two ends of said two bolts respectively in order to compress said holding frame and said picture holding pocket body onto said front and back surfaces of said transparent board respectively so as to hold said picture received in said receiving pocket rigidly in position.

5. A wall hanging picture frame, as recited in claim 1, wherein said picture holding pocket body further has at least two holding holes provided thereon, wherein said two holding holes are aligned with respect to said two through holes on said transparent board, said two connectors further penetrating through said two holding holes to mount said picture holding pocket body in position.

6. A wall hanging picture frame, as recited in claim 2, wherein said picture holding pocket body further has at least two holding holes provided thereon, wherein said two holding holes are aligned with respect to said two through holes on said transparent board, said two connectors further penetrating through said two holding holes to mount said picture holding pocket body in position.

7. A wall hanging picture frame, as recited in claim 3, wherein said picture holding pocket body further has at least two holding holes provided thereon, wherein said two holding holes are aligned with respect to said two through holes on said transparent board, said two connectors further penetrating through said two holding holes to mount said picture holding pocket body in position.

8. A wall hanging picture frame, as recited in claim 4, wherein said picture holding pocket body further has at least two holding holes provided thereon, wherein said two holding holes are aligned with respect to said two through holes on said transparent board, said two connectors further penetrating through said two holding holes to mount said picture holding pocket body in position.

9. A wall hanging picture frame, as recited in claim 1, wherein said securing means comprises at least two ending enlarged heads integrally and respectively formed at two ends of said two connectors, each of said enlarged heads having a through slot therethrough.

10. A wall hanging picture frame, as recited in claim 9, wherein said picture holding pocket body also has at least two holding holes provided with respect to said two through holes, said two ending enlarged heads being compressed and forced to penetrate through said through holes of said transparent board and said holding holes of said picture holding pocket body respectively in order to secure said picture holding pocket body as well as said picture firmly in position.

11. A wall hanging picture frame, as recited in claim 10, wherein said holding frame is a quadrilateral holding frame, and that there are totally four through holes provided at four corners of said transparent board and four holding holes provided at four corners of said picture holding pocket body with respect to said four through holes.

* * * * *